US007963309B2

(12) United States Patent
Simmelsgaard et al.

(10) Patent No.: US 7,963,309 B2
(45) Date of Patent: Jun. 21, 2011

(54) MATERIAL TRANSFER DEVICE WITH A PROTECTIVE COVER

(75) Inventors: Peter A Simmelsgaard, Vissenbjerg (DK); Frank Nielsen, Tommerup (DK)

(73) Assignee: 3L-Ludvigsen A/S, Tommerup (DK)

( * ) Notice: Subject to any disclaimer, the term of this patent is extended or adjusted under 35 U.S.C. 154(b) by 683 days.

(21) Appl. No.: 11/672,157

(22) Filed: Feb. 7, 2007

(65) Prior Publication Data

US 2007/0193694 A1 Aug. 23, 2007

Related U.S. Application Data

(60) Provisional application No. 60/774,778, filed on Feb. 17, 2006.

(51) Int. Cl.
*B32B 37/00* (2006.01)

(52) U.S. Cl. ..... 156/577; 156/574; 156/579

(58) Field of Classification Search ..... 156/71, 156/574, 577, 579, 538, 539, 540; 118/207
See application file for complete search history.

(56) References Cited

U.S. PATENT DOCUMENTS 4,376,593 A * 3/1983 Schaefer ..... 403/231
6,761,200 B2 * 7/2004 Shinya ..... 156/577
6,842,626 B1 * 1/2005 Kubo et al. ..... 455/550.1

* cited by examiner

*Primary Examiner* — James Sells
(74) *Attorney, Agent, or Firm* — Klein, O'Neill & Singh, LLP

(57) ABSTRACT

A material transfer device for transferring a coating from an outer surface of a transfer tape onto a surface includes a housing; a transfer head around which the transfer tape extends, wherein the transfer head protrudes from the housing; a protective cover connected to the housing and movable between an advanced and a retracted position. The cover has a front end portion adapted to protrude from the housing in the advanced position for protecting an unused portion of the transfer tape when the device is out of use. The connection between the protective cover and the housing is provided by a groove in the protective cover and tongue on the outer surface of the housing.

7 Claims, 1 Drawing Sheet

MATERIAL TRANSFER DEVICE WITH A PROTECTIVE COVER

CROSS-REFERENCE TO RELATED APPLICATION

This application claims the benefit, under 35 U.S.C. §119 (e), of provisional U.S. Application No. 60/774,778, filed Feb. 17, 2006, the disclosure of which is incorporated herein by reference.

FEDERALLY SPONSORED RESEARCH OR DEVELOPMENT

Not Applicable

BACKGROUND OF THE INVENTION

The present invention relates to a material transfer device for transferring a coating from an outer surface of a transfer tape onto a surface.

In material transfer devices of this kind, it is known to provide a protective cover in the form of a plate, which is slideably connected to the housing, the housing comprising a recess in which the plate is slidingly positioned. Such a material transfer device is known from U.S. Pat. No. 6,761,200, in which the connection between the protective cover and the housing is relatively complex with an intricately formed recess in the housing for holding and guiding the protective cover, said cover comprising correspondingly intricate formations for the mutual engagement, and the assembly of the housing and the protective cover requiring relatively precise positioning of several parts relative to one another.

SUMMARY OF THE INVENTION

Broadly, the present invention is a material transfer device for transferring a coating onto a surface from an outer surface of a transfer tape, of the type including a housing; a transfer head around which the transfer tape extends, said transfer head protruding from the housing; a protective cover connected to the housing and movable between an advanced and a retracted position, the cover having a front end portion that protrudes from the housing in the advanced position for protecting an unused portion of the transfer tape when the device is out of use, wherein the improvement comprises a tongue and groove connection between the protective cover and the housing.

BRIEF DESCRIPTION OF THE DRAWINGS

In the following detailed part of the present description, the invention will be explained in more detail with reference to the exemplary embodiment of a material transfer device according to the invention shown in the drawings, in which.

DESCRIPTION OF THE PREFERRED EMBODIMENT

Figure 1:
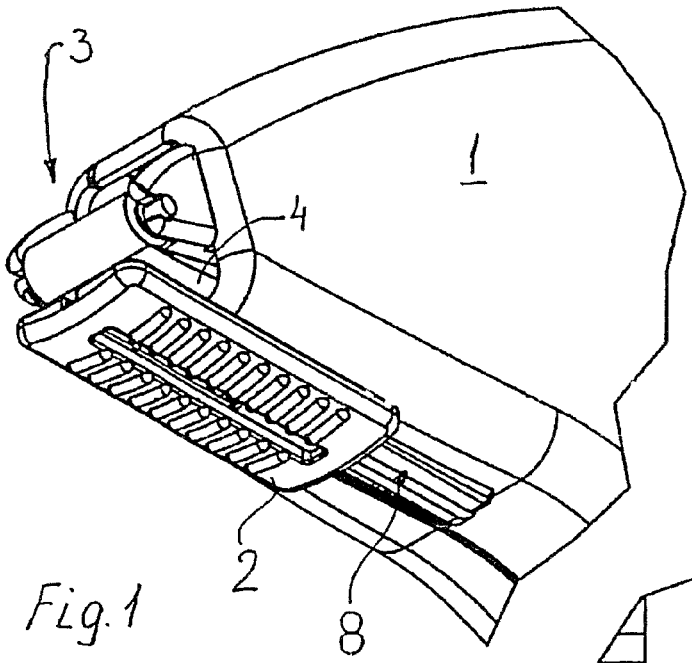
FIG. 1 is a perspective view of the essential parts of a material transfer device according to the invention.

The material transfer device partially shown in FIG. 1 comprises a housing for containing a transfer tape suitably positioned on mutually connected reels for controlling the movement of the transfer tape 4 in and out of the housing around the transfer head 3 protruding out of the housing 1. The transfer tape 4 extending around the transfer head 3 carries a film-like coating, e.g. made of correcting material, adhesive tape, precut tape pieces, or paste on its outer surface, such that when pressing the transfer tape 4 and the transfer head 3 against a surface to be coated and moving the material transfer device relative to said surface, the film-like coating is transferred from the transfer tape 4 onto said surface during corresponding movement of the transfer tape 4 in and out of the housing 1 around the transfer head 3.

A protective cover 2 is connected to the housing 1 by means of a tongue and groove connection which, in the preferred embodiment, comprises a groove 5 in the protective cover 2 engaging a tongue 6 on the outer surface of the housing 1. The protective cover 2 is thus slideably connected to the housing 1 in order to be movable between a retracted position, in which the transfer head 3 and the transfer tape 4 can be used for transferring the material from the transfer tape 4 to a surface to be covered by a coating, and a protruding position, in which the protective cover 2 covers the underside of the transfer tape 4 and transfer head 3, whereby the coating on the transfer tape 4 is protected against unintentional contact with other material.

Figure 2:
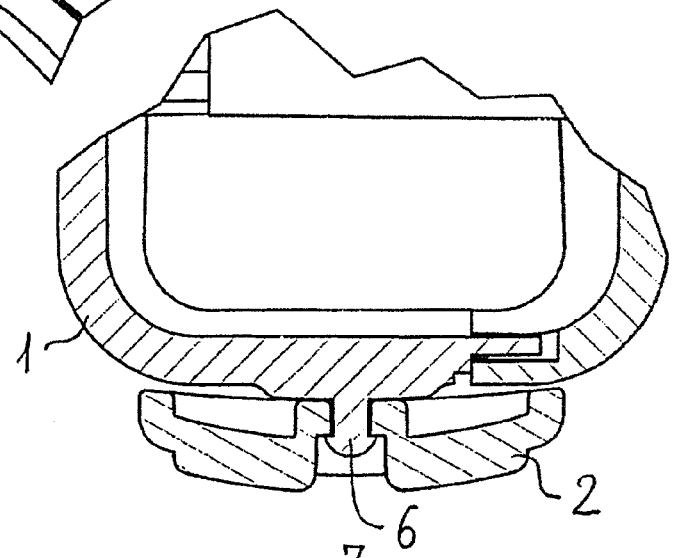
FIG. 2 is a cross-section showing details of the connection between the housing of the material transfer device and the protective cover.

As shown in FIG. 2 the connection between the groove 5 in the protective cover 2 and the tongue 6 on the housing 1 provides a guiding of the protective cover 2 for a linear movement along the tongue 6. As an alternative the movement could also be curved i.e. a curved tongue 6 and groove 5. The dimension of the groove 5 and the tongue 6 are mutually adjusted in such a way that the tongue 6 provides and end stop for the movement of the protective cover 2 in each of the above-mentioned retracted and extended position. Furthermore the groove 5 and the tongue 6 may be provided with small enlargements 7, 8 providing a certain fixation of the protective cover 2 in each of the two mentioned end positions. Alternatively said fixation could be provided by any similar cooperating engagement formations on the tongue, housing, groove and protective cover.

In order to assemble the housing 1 and the protective cover 2, the tongue 6 preferably has a mushroom-like cross-section as shown in FIG. 2, whereby the protective cover 2 can be clicked into position due to the flexibility of the protective cover 2, whereby the groove 5 is widened out to pass over the widening of the tongue 6. As an alternative or supplement the tongue could also exhibit a certain flexibility, e.g. by being provided with a slit in the top of the mushroom-shaped tongue 6. Another possibility would be to provide the groove 5 so as to be open at one end, and to slide the groove 5 into engagement with the tongue 6.

Figure 3:
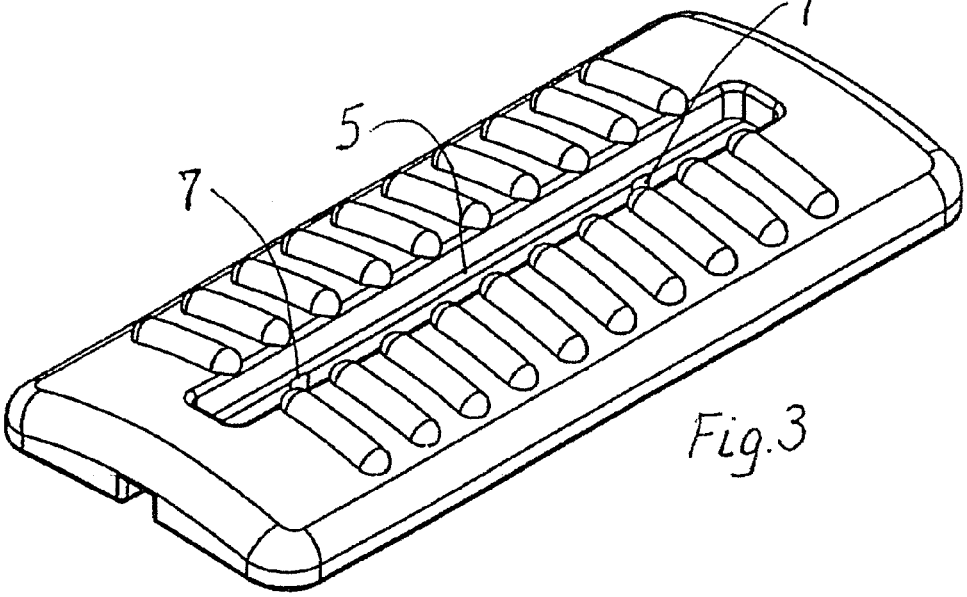
FIG. 3 is a perspective view of a protective cover for use in a material transfer device in accordance with the present invention.

As shown in FIG. 3, the protective cover 2 may advantageously be provided with ribs in order to provide a secure engagement of a finger moving the protective cover 2 along the tongue 6 between the above-mentioned end positions.

As shown in FIGS. 1 and 2, the housing 1 includes a bottom portion 11, a top portion 12, and a side wall 13 that is flexibly or pivotably attached, as at 14 (FIG. 1), to the top portion 12. The side wall 13 has a first underslung latching lip 15 that is cooperatively engageable with a second latching lip 16 that is formed in the bottom portion 11 to form a latch that detachably connects the side wall 13 and the bottom portion 11 of the housing 1. Thus, when the first and second latching lips 15, 16 are disengaged, the side wall 13 can be flexed or pivoted outward away from the rest of the housing 1 to allow access to interior of the housing 1, thereby allowing the tape reels (not shown) contained therein to be changed. As shown in FIG. 2, the first and second latching lips 15, 16 are located between the protective cover 2 and the bottom portion 11 of the housing, with the cover 2 being spaced from the lips 15, 16 by the tongue and groove connection, so that the lips 15, 16 can be disengaged, and the side wall 13 opened, without removing the cover 2.

Above the invention has been described in connection with a preferred embodiment and many modifications may be envisaged without departing from the scope of the appended claims.

The invention claimed is:

1. A material transfer device for transferring a coating from an outer surface of a transfer tape onto a surface, of the type comprising a housing having a bottom portion; a transfer head around which the transfer tape extends, said transfer head protruding from the housing; and a protective cover connected to the bottom portion of the housing and movable between an advanced and a retracted position, the protective cover having a front end portion adapted to protrude from the housing in the advanced position so as to cover the transfer head for protecting an unused portion of the transfer tape;

wherein the improvement comprises a tongue and groove connection between the protective cover and the bottom portion of the housing, wherein the tongue and groove connection is configured to allow the cover to be movable between the advanced position and the retracted position, wherein the tongue and groove connection comprises a single tongue extending along the bottom portion of the housing and a single groove that extends along the protective cover in alignment with the single tongue and that cooperatively engages the single tongue.

2. The material transfer device of claim 1, wherein the tongue and groove connection is formed to provide a clip-on function between the groove and the single tongue.

3. The material transfer device of claim 1, wherein the single tongue and the groove include cooperating enlargements positioned for fixing the cover in the advanced and retracted positions.

4. The material transfer device of claim 1, wherein the single tongue has a mushroom-like cross section.

5. The material transfer device of claim 1, wherein the groove has opposed ends, and wherein the single tongue and the groove are configured so that engagement between the single tongue and each of the ends of the groove provides end-stops for the movement of the protective cover.

6. The material transfer device of claim 1, wherein the groove extends completely through the protective cover.

7. The material transfer device of claim 1, wherein the housing includes a side wall and a latch that detachably connects the side wall and the bottom portion, the latch being located between the protective cover and the bottom portion.

* * * * *